United States Patent [19]

Mormile

[11] 4,120,055

[45] Oct. 17, 1978

[54] TWO-STAGE TOILET FLUSHING APPARATUS

[76] Inventor: Paul F. Mormile, R.D. #1, Box 215, Mechanicville, N.Y. 12118

[21] Appl. No.: 842,825

[22] Filed: Oct. 17, 1977

Related U.S. Application Data

[63] Continuation of Ser. No. 666,543, Mar. 15, 1976, abandoned.

[51] Int. Cl.[2] ..... E03D 1/36; E03D 5/02

[52] U.S. Cl. ..... 4/324; 4/366; 4/393

[58] Field of Search ..... 4/324, 325, 326, 333, 4/366, 374, 393, 398, 415, 378; 137/426

[56] References Cited

U.S. PATENT DOCUMENTS

| | | | |
|---|---|---|---|
| 1,110,432 | 9/1914 | Fraser | 4/398 |
| 1,984,394 | 12/1934 | Candee | 4/374 |
| 3,024,799 | 3/1962 | Fleider | 137/426 X |
| 3,095,377 | 7/1963 | Clark | 4/325 X |
| 3,401,717 | 9/1968 | Lamb | 137/426 X |
| 3,533,437 | 10/1970 | Young | 137/426 X |
| 3,945,057 | 3/1976 | Therkelsen | 4/324 |
| 3,956,777 | 5/1976 | Hockly | 4/325 |

*Primary Examiner*—Stuart S. Levy
*Attorney, Agent, or Firm*—Pollock, Vande Sande & Priddy

[57] ABSTRACT

A flushing apparatus for a toilet includes means for positioning the float for the conventional water control valve in either a first, lower position at which a low water level is maintained or a second, higher position at which a higher water level is maintained. Partial rotation of the conventional flushing handle releases the float from the first position to permit the water level in the toilet tank to rise to the higher level controlled by the float in the second position.

10 Claims, 10 Drawing Figures

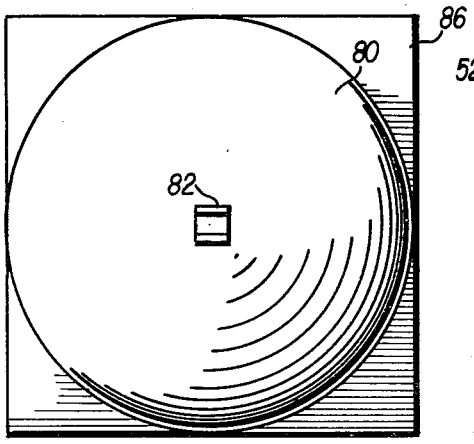
FIG. 6A
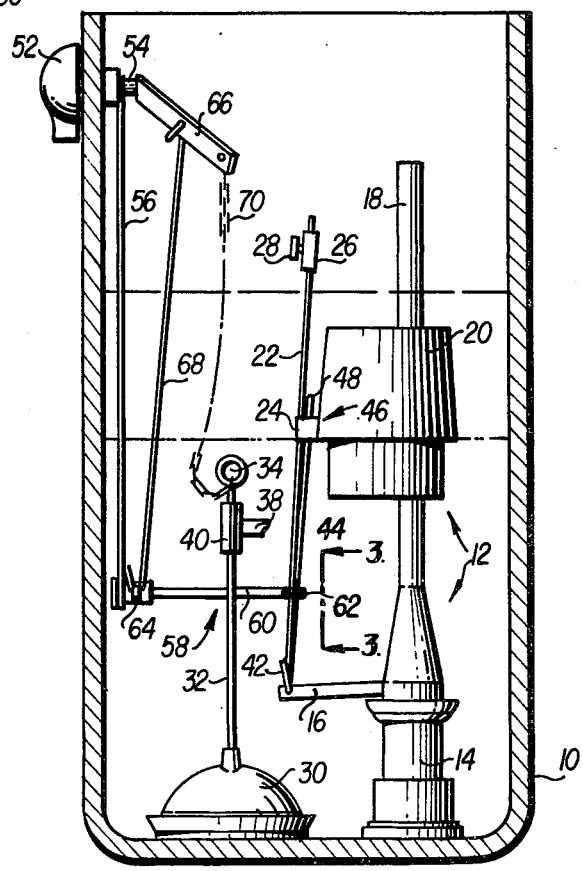
FIG. 2
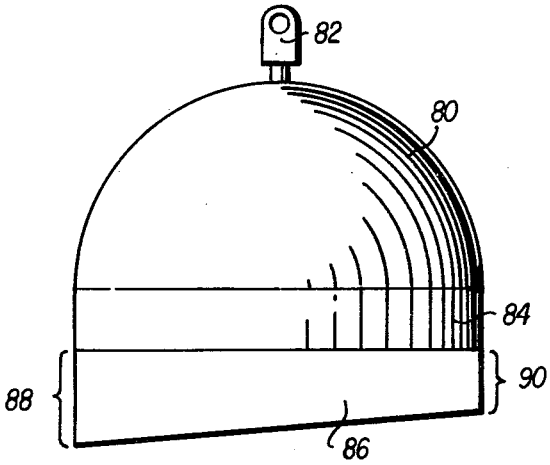
FIG. 6B
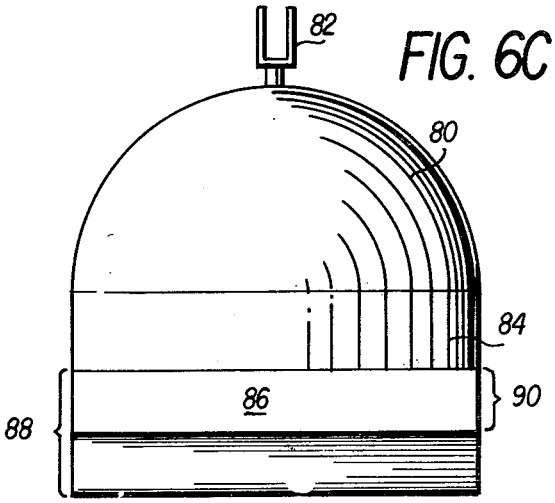
FIG. 6C
FIG. 7
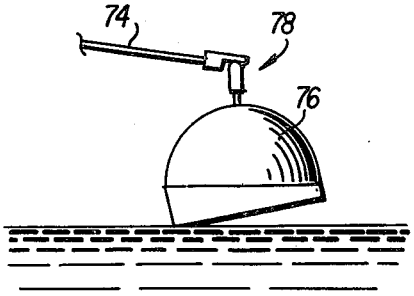

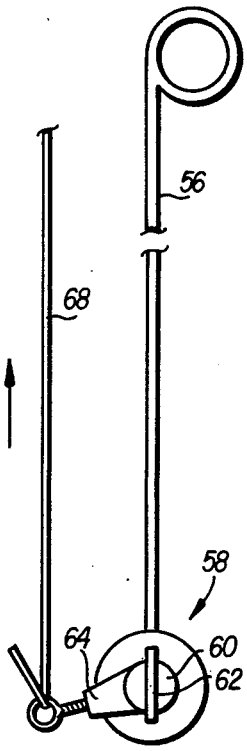
FIG. 3A
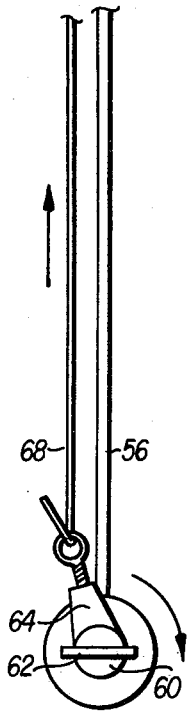
FIG. 3B
FIG. 5
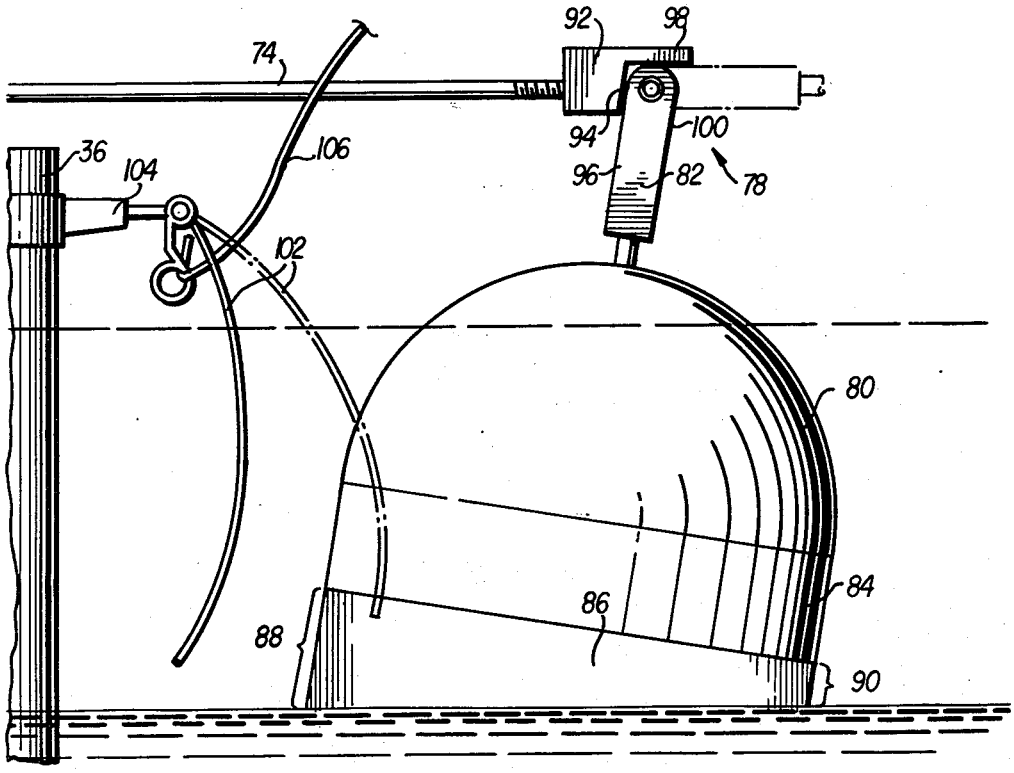

TWO-STAGE TOILET FLUSHING APPARATUS

BACKGROUND OF THE INVENTION

In recent years, increasing concern has been voiced by the public utilities and various conservationists that available sources of fresh water shortly will no longer be adequate due to the increasing demands of industry and the public. Thus, there have been concerted efforts to develop ways of more economically using available water supplies. One aspect of water used which has received some attention is the very considerable amount of water which is required simply for flushing the toilets found in private homes and businesses. It has been noted that a considerably smaller amount of water is required to adequately flush liquid wastes from the conventional toilet bowl than to adequately flush solid waste. Unfortunately, most flushing apparatus available on the market today provides for release of a fixed volume of water into the toilet bowl regardless of the type of waste to be flushed. One recent exception is the apparatus disclosed in U.S. Pat. No. 3,795,016 issued to Edward A. Eastman on Mar. 5, 1974. Through the use of a pair of flushing valves located at different levels in the conventional toilet tank, the patentee has provided a toilet water tank with light and heavy flush control. Unfortuntely, the adaptation of conventional flush toilets to the use of the Eastman device necessitates the replacement of most of the elements of the conventional flushing apparatus.

OBJECTS OF THE INVENTION

An object of the invention is to provide a two-stage flushing apparatus which may be readily adapted to conventional flushing apparatus without requiring the replacement of a large number of parts.

Another object of the invention is to provide a flushing apparatus which will always release a small volume of water sufficient for flushing normal liquid waste unless selectively actuated to release a larger volume of water for flushing solid waste.

Another object of the invention is to provide a flushing apparatus which may be selectively actuated to release either a small or a large volume of water by a simple movement of a single flush control handle located on the exterior of the conventional toilet tank.

The above objects of the invention are given only by way of example; thus, other objects and advantages inherently achieved by the invention may occur to those skilled in the art. In any event, the invention provides certain distinct advantages as will be understood by those in the art from the following description.

SUMMARY OF THE INVENTION

The above and other objects are achieved by the flushing apparatus according to the present invention which is suited for use in toilets of the type including a water reservoir tank, a source of water, a float positioned to ride on the surface of the water within the tank and a valve actuated in response to the float position for turning off and on the water from the source. The invention provides means operatively connecting the valve and float for closing the valve in response to the presence of a buoyant force from the float and for opening the valve in response to the loss of buoyant force from the float. Apparatus is provided for selectively positioning the float in the tank to exert this buoyant force at either a first low water level or a second high water level, whereby sufficient water is maintained in the tank for flushing liquid waste at the first water level or for flushing solid waste at the second water level.

BRIEF DESCRIPTION OF THE DRAWINGS

FIG. 2 shows a side elevational view of the invention, partially cut away, taken along line 2—2 of FIG. 1.

FIGS. 3A and 3B show successive views of the float positioning mechanism according to the invention, taken along line 3—3 of FIG. 2.

FIG. 5 shows an enlarged fragmentary view of a portion of the structure shown in FIG. 4, indicating the cooperation between the float, the float positioning mechanism and the float support lever.

FIGS. 6A, 6B and 6C show top, front and side views of the float used in the embodiment of FIG. 4.

FIG. 7 indicates the manner in which the float of the embodiment of FIG. 4 enters the water in use.

DETAILED DESCRIPTION OF THE PREFERRED EMBODIMENTS

Figure 1:
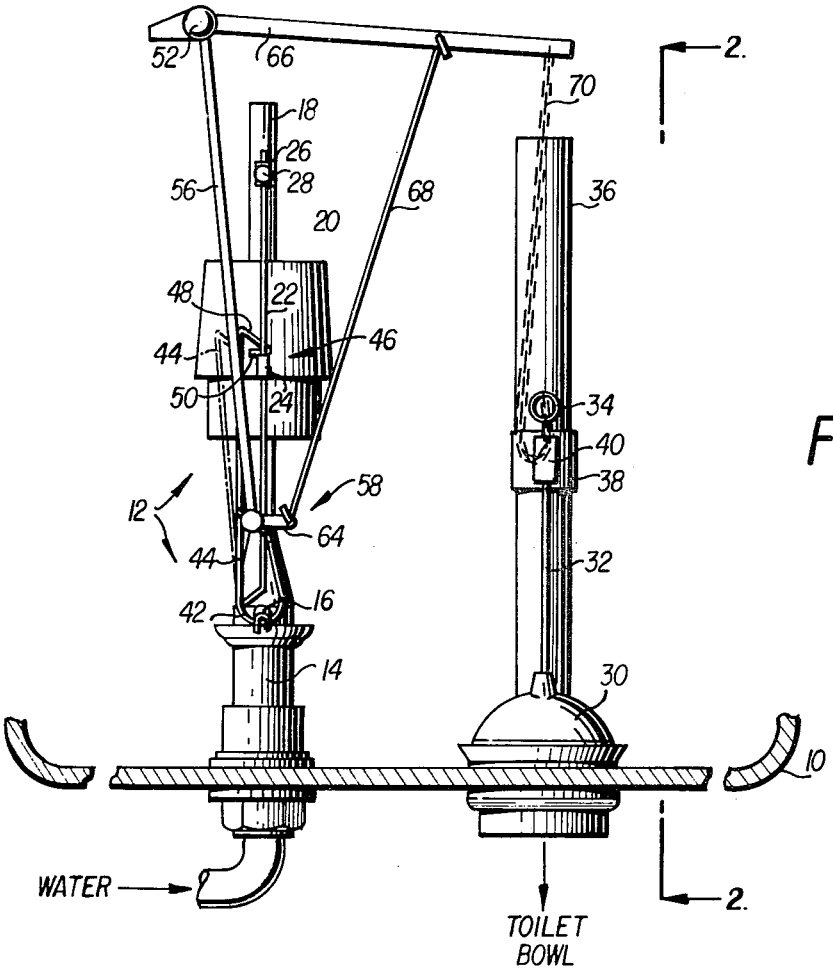
FIG. 1 shows an elevational, partially sectional, view of the interior components of a flushing apparatus according to one embodiment of the invention.

There follows a detailed description of the preferred embodiments of the invention, reference being had to the drawings in which like reference numerals identify like elements of structure in each of the several Figures.

Referring to FIGS. 1 and 2, a conventional flush tank 10 is shown enclosing a float valve assembly 12 with a valve 14 for turning on and shutting off the water required to fill tank 10. Valve 14 is actuated by an actuator arm 16. An upwardly extending float support column 18 is provided which slideably guides a float cup 20 so that cup 20 rises and falls within tank 10 as the water level therein changes during use. A link 22, which preferably is of resilient wire or rod, is attached to actuator arm 16 and extends upwardly through a bore (not shown) located in a guide tab 24 which extends radially from float cup 20. Thus, float cup 20 is free to slide up and down on link 22. At the upper end of link 22, an upper level control stop 26 is slideably mounted with a set screw 28, to permit variation in the amount of upward movement of float cup 20.

A conventional tank ball or valve element 30 normally closes flow of the water from tank 10 to the toilet bowl and includes an upwardly extending control link 32 having an eye 34 at its upper end. The usual conventional overflow pipe 36 includes a lateral support arm 38 having a guide 40 which slideably receives link 32 in a bore (not shown).

In a conventional flushing apparatus of the type described to this point, the operation is familiar to those in the art. Assume initially that the tank 10 is full of water and float cup 20 is bearing upwardly against upper level control stop 26. In this condition, the buoyant force of float cup 20 pulls upwardly on link 22, thereby rotating actuator arm 16 and closing valve 14 to shut off the flow of water into tank 10. Also, tank ball or valve 30 is resting on its seat at the bottom of tank 10 so that the water within tank 10 is prevented from flowing downwardly to the toilet bowl. When it is desired to flush the toilet, tank ball 30 is raised from its seat by the conventional flushing handle so that water flows from tank 10 to the toilet bowl. As the water flows from tank 10 to the toilet bowl, float cup 20 begins to slide down link 22, following the falling water level in tank 10. The loss of the buoyant force of float cup 20 acting on link 22 allows the acutator arm 16 of valve 14 to move downward thereby opening valve 14 and turning on the flow of water into tank 10. When the level of water in tank 10 has dropped sufficiently, tank ball 30 will reseat in the bottom of the tank, closing off flow of water to the toilet bowl. At this time, float cup 20 has reached a low level on link 22 and valve 14 remains open. As the water in tank 10 rises, float cup 20 slides upwardly along support column 18 and link 22 until contact is established between guide tab 24 and upper level control stop 26. The buoyant force of float cup 20 then closes valve 14 in the manner previously discussed. It is apparent that such prior art devices are arranged for flushing with only a single volume of water and that considerably waste is involved.

In accordance with the present invention, a hook 42 is provided which attaches link 22 to actuator arm 16. Extending upwardly from hook 42 in generally parallel but spaced apart relationship to link 22 is a resilient stop arm 44 which preferably is of resilient wire or rod. At the upper end of resilient stop arm 44, a lower level control stop 46 is located. Lower level control stop 46 extends laterally from resilient stop arm 44 and includes an angled camming portion 48 and a horizontal stop portion 50. Stop portion 50 is located so that as float cup 20 moves up along link 22, guide tab 24 will contact stop 50, thereby holding float cup 20 at a first, lower water level. In this situation, the buoyant force of float cup 20 will be applied to actuator arm 16 when the level of water in tank 10 has reached a substantially lower level than would be the case if float cup 20 were permitted to rise until contact was made with upper level control stop 26.

The invention also provides means for selectively positioning float cup 20 at either the first, lower water level provided by lower level control stop 46 and shown in phantom in FIG. 2 or the second, higher water level provided by upper level control stop 26 also shown in phantom. Referring also the FIGS. 3A and 3B, a conventional flush handle 52 located at the upper portion of tank 10 includes a shaft 54 which extends interiorly of tank 10. A downwardly depending, stationary support 56 is mounted to, but does not rotate with, shaft 54, At the lower end of support 56, a float cup release mechanism 58 is located. Release mechanism 58 comprises an elongated shaft 60 which extends from the lower end of stationary support 56 to a location between link 22 and resilient stop arm 44. Shaft 60 is rotatably mounted at the lower end of stationary support 56 and includes a stop release cam or blade 62 at the end between link 22 and arm 44 and a crank arm 64 at the end adjacent stationary support 56. A conventional flush lever arm 66 is mounted on shaft 54 for rotation therewith. A rigid link 68 extends from lever arm 66 to crank arm 64 so that float cup release mechanism 58 may be actuated by turning flush handle 52. A chain or other flexible link 70, longer than link 68 so that crank arm 68 may be rotated before tank ball 30 is lifted by the chain, also joins flush lever arm 66 to eye 34 located at the upper end of control link 32 of tank ball 30.

In operation, with float cup 20 stopped at lower level control stop 46, sufficient water is allowed to flow into in tank 10 for flushing liquid waste. If the flushing of solid waste is anticipated, flush handle 52 is turned through an arc of approximately 90° so that crank arm 64 is rotated by rigid link 68 and flush lever arm 66. The rotation of crank arm 64 causes stop release cam 62 to rotate between link 22 and arm 44, thereby forcing arm 44 to the phantom position illustrated in FIG. 1 and releasing float cup 20 for movement up link 22. The loss of buoyant force from float cup 20 acting on link 22 causes valve 14 to open, thereby allowing the water level to rise to a second, higher water level suitable for disposing of solid waste. To flush the device, flush handle 52 is rotated through an additional arc sufficient to pull chain 70 taut and raise tank ball 30 from its seat in the bottom of tank 10. This permits the water to flow into the toilet bowl. As float cup 20 falls downward along link 22, guide tab 24 contacts angled camming portion 48 of the lower control stop 46 thereby forcing resilient stop arm 44 to move asid to the phantom position shown in FIG. 1. This permits float cup 20 to follow the water level to its lowest position. Thereafter, the device refills in the manner previously described.

Figure 4:
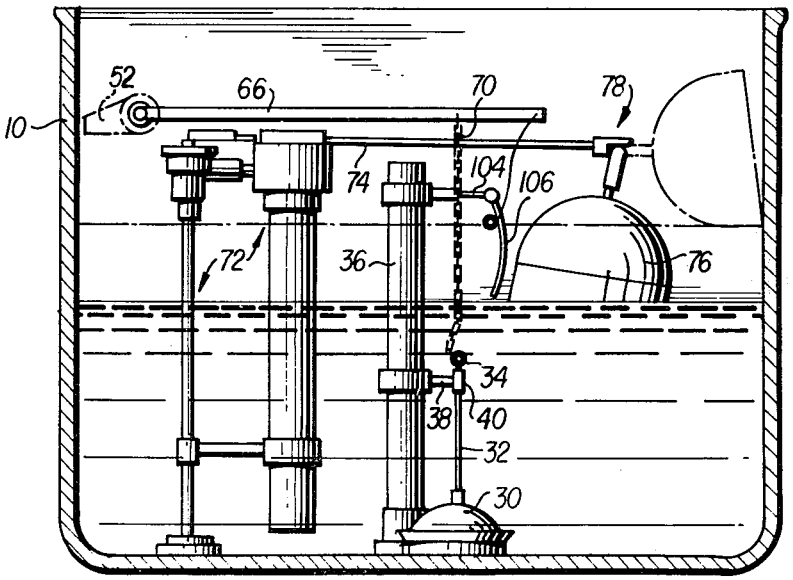
FIG. 4 shows an elevational, partially sectional, view of another embodiment of the invention.

Referring now to FIGS. 4 and 5, a second embodiment of the invention may be understood. A conventional float valve and vacuum breaker assembly 72 is located within tank 10 and is actuated by movement of a rigid link 74 which moves in response to the position of a float 76. Those skilled in the art will realize that in this general type of flushing apparatus, float valve assembly 72 is closed when the water level in tank 10 has moved sufficiently far upward to cause float 76 to exert a large enough buoyant force on the end of link 74. Conversely, when the water level drops due to the opening of tank ball 30 in the conventional manner, float 76 drops and opens float valve assembly 72.

In the present invention, the operation of the prior art device is modified advantageously by the inclusion of a hinge element 78 between rigid link 74 and float 76. Also, the geometry of the conventional float is modified in accordance with this invention. Float 76 comprises a hemi-spherical portion 80 to which is attached one half 82 of hinge 78. Extending downwardly from hemispherical portion 80 is a cylindrical portion 84 to which is attached a square or rectangular buoyant biasing wedge portion 86. Wedge portion 86 tapers from a maximum thickness at 88 to a minimum at 90 so that the overall float assembly 76 is asymmetrical relative to an axis of the float through hinge 78.

The other half 92 of hinge 78 includes a stop surface 94 which is angled toward float valve and vacuum breaker assembly 72 in position to contact edge 96 of hinge half 82. Hinge half 78 also includes a laterally extending stop surface 98 which projects in a direction approximately parallel to the axis of rigid link 74 in a position to contact edge 100 of hinge half 82.

Referring briefly to FIG. 7, the significance of the asymmetry of float 76 may be understood. Because of the presence of biasing wedge 86, the edge of wedge 86 located at its point of maximum thickness 88 will enter the water within tank 10 first as the water level rises. Thus, the initial buoyant force exerted on float 76 will be at a location to the left of hinge 78, as viewed in FIGS. 4, 5 and 7. This asymmetric application of the buoyant force causes float 76 to pivot in a clockwise direction, thereby bringing edge 96 into contact with stop surface 94. The buoyant force of float 76 thus acts via rigid link 74 to close float valve assembly 72 with float 76 at a first, lower water level suitable for flushing liquid waste.

As in the previous embodiment, means are also provided for positioning float 76 at a second, higher water level suitable for flushing solid waste. A curved float trip arm 102 is pivotably mounted on a support arm 104 attached to the conventional overflow pipe 36. Trip arm 102 is actuated by a rigid link 106 which is connected between trip arm 102 and flush lever 66. To understand the operation of this embodiment, assume initially that the device has just been flushed so that float 76 is hanging downwardly from rigid link 74 as indicated in FIG. 7. As the water level rises, float 76 will be pivoted clockwise into contact with stop surface 94 of hinge 78. As float 76 continues to rise, sufficient buoyant force will eventually be applied to rigid link 74 to close conventional float valve and vacuum head assembly 72, in the usual manner. Thus, the water level is established at a first, lower level suitable for flushing liquid waste. If it is desired to raise the water level to a second, higher level suitable for flushing solid waste, flush handle 52 is rotated through an arc of approximately 90° so that link 106 pivots float trip arm 102 into contact with float 76. This causes float 76 to pivot in a counterclockwise direction until the line of action of the buoyant force acting upwardly on float 76 moves to the right of hinge 78 as illustrated in FIGS. 4, 5 and 7. This causes float 76 to pivot quickly to the position shown in phantom in FIG. 4 in which edge 100 is in contact with stop surface 98. In this orientation, the buoyant force exerted by float 76 is insufficient to maintain float valve assembly 72 in its closed position; therefore, the water level rises to the second, higher position shown in phantom in FIG. 4 at which location float valve assembly 72 again closes. To flush, handle 52 is rotated through an additional arc so that chain 70 becomes taut and lifts tank ball 30. During the flushing cycle, as the water level drops, float 76 returns to the position shown in FIG. 7 so that the apparatus will return the water level to its initial, lower position.

Having described my invention in sufficient detail to enable those skilled in the art to make and use it, I claim:

1. Flushing apparatus for a toilet having a water tank containing a float actuating a first valve to control the amount of water admitted to the tank and also containing a second valve operable to flush the water stored in the tank into the toilet bowl, the improvement which comprises:

handle means including a single manually actuable handle operable between a first normal position and distinct first and second actuated positions, said handle in its said first normal position permitting closure of said second valve so as to permit the filling of the tank when said first valve is open, operating means for said first valve controlled jointly by said float and by said handle means when said handle is in its said normal position to permit closure of said first valve when the water level in the tank reaches a first predetermined partially-filled level, said operating means for said first valve being controlled jointly by said float and by said handle means when said handle is in its said first actuated position to close said first valve only when the water level in the tank reaches a second level higher than said first level, and flushing means controlled by said handle means when said handle is moved to its said second actuated position to open said second valve to flush the bowl with the quantity of water then stored in the tank.

2. An apparatus according to claim 1, wherein said operating means for said first valve comprises a rigid linkage interconnecting said float mechanism and said first valve.

3. An apparatus according to claim 1 wherein said operating means for said first valve comprises a first link connected to said first valve, along which first link said float is adapted to move; said operating means for said first valve further comprising a first stop for said float on said first link, and a second stop for said float located above said first stop on said first link; and means for selectively disengaging said first stop from said float to permit said float to rise to said second stop.

4. An apparatus according to claim 3, wherein said first stop is resiliently mounted on said first link.

5. An apparatus according to claim 3 further comprising a pivoted lever operatively associated with said handle means, a flexible link operatively connecting said lever to said second valve, a second link shorter than said flexible link and having one end thereof connected to said pivoted lever, and crank means connected to the other end of said second link for disengaging said first stop upon rotation of said pivoted lever through a first arc, said first arc being insufficient because of the greater length of said flexible link than said second link to cause said pivoted lever to tighten said flexible link and open said second valve.

6. An apparatus according to claim 1, wherein said first valve operating means comprises a rigid link interconnecting said float and said first valve; and hinge means connecting said float to said rigid link to permit said float to be rotated between a first, lower position and a second, higher position; and means controlled by said handle means for selectively moving said float from said first to said second position, whereby said first valve is closed at said first low water level when said float is in said first, lower position and is closed at said second high water level when said float is in said second, higher position.

7. An apparatus according to claim 6 which includes means for biasing said float into said first, lower position as the water level rises following flushing.

8. An apparatus according to claim 7 which further includes means comprising a pivoted lever operatively associated with said handle means, a flexible link operatively connecting said lever to said second valve, a second link shorter than said flexible link connected at one end thereof to said pivoted lever and a trip lever pivotably mounted to said handle means for movement by said second link, said trip lever being positioned to rotate said float from said first, lower position to said second, upper position.

9. An apparatus according to claim 7, wherein said biasing means comprises a buoyant member attached to the underside of said float, said buoyant member being asymmetric relative to an axis of said float extending through said hinge means, whereby said buoyant member first contacts said water on one side of said axis as the water level rises, thereby causing said float to pivot toward said one side into said lower position.

10. An apparatus according to claim 6, wherein said hinge means includes stops for preventing float movement beyond said first, lower and second, higher positions.

* * * * *